United States Patent [19]

Altman

[11] 4,155,226

[45] May 22, 1979

[54] INFRARED COOLER FOR RESTRICTED REGIONS

[76] Inventor: Gerald Altman, 41 Westminster Rd., Newton Centre, Mass. 02159

[21] Appl. No.: 707,852

[22] Filed: Jul. 22, 1976

Related U.S. Application Data

[63] Continuation-in-part of Ser. No. 445,052, Feb. 25, 1974, Pat. No. 3,994,277, which is a continuation-in-part of Ser. No. 422,426, Dec. 6, 1973, abandoned.

[51] Int. Cl.[2] ..... F25B 23/00

[52] U.S. Cl. ..... 62/467 R; 62/DIG. 1; 126/270; 237/1 A

[58] Field of Search ..... 237/1 A; 126/270, 400; 62/467, DIG. 1; 250/503, 504

[56] References Cited

U.S. PATENT DOCUMENTS

| | | | |
|---|---|---|---|
| 2,949,014 | 8/1960 | Belton, Jr. et al. | 62/DIG. 1 |
| 3,248,547 | 4/1966 | Geijn | 250/503 |
| 3,796,886 | 3/1974 | Freeman | 250/503 |
| 3,801,785 | 4/1974 | Barrett | 250/503 |
| 3,869,199 | 3/1975 | Cummings | 126/270 |
| 3,959,660 | 5/1976 | Tolliver | 250/504 |
| 4,030,316 | 6/1977 | Aronson | 62/467 |

*Primary Examiner*—Ronald H. Lazarus
*Assistant Examiner*—P. S. Lall
*Attorney, Agent, or Firm*—Morse, Altman, Oates & Bello

[57] ABSTRACT

Intensified infrared cooling of a restricted region is achieved by locating the region in the path defined by a geometric configuration, in which a small infrared radiation sink and a large infrared radiation condenser are axially related.

33 Claims, 6 Drawing Figures

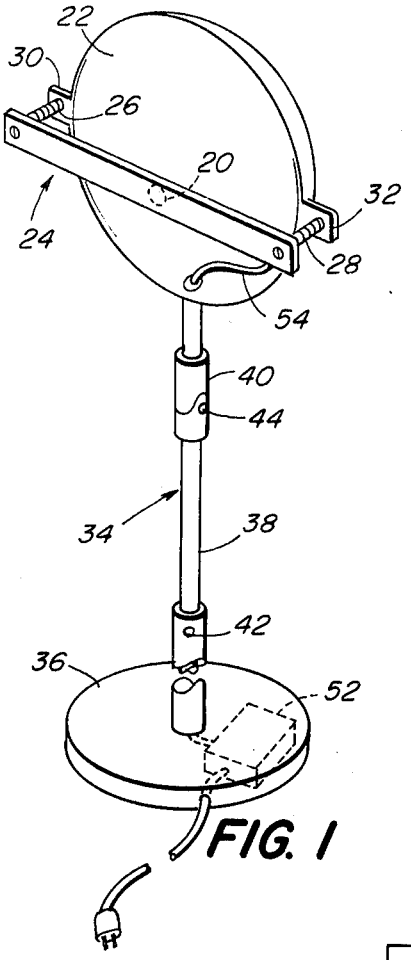
FIG. 1
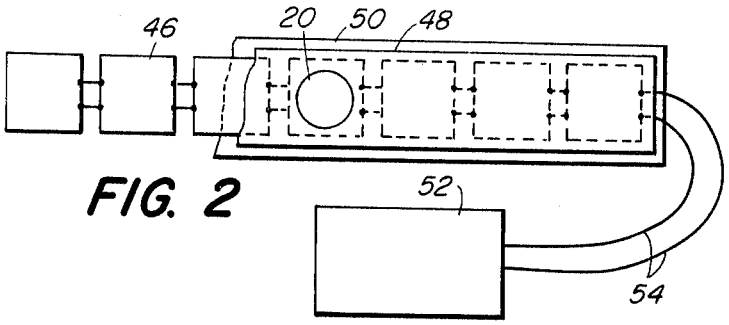
FIG. 2
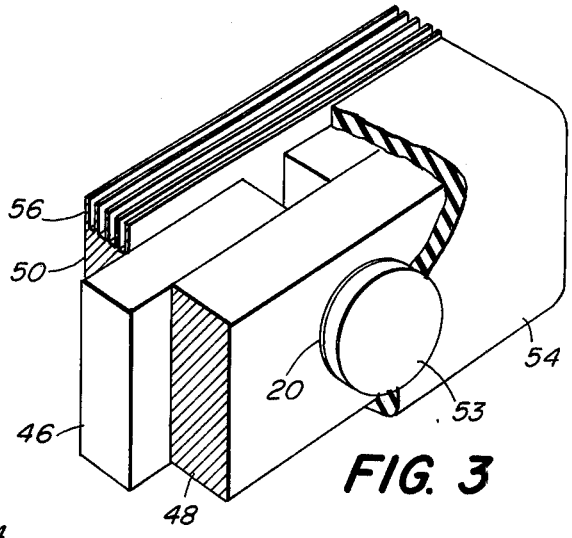
FIG. 3
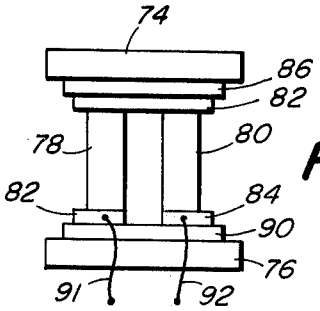
FIG. 4
FIG. 5
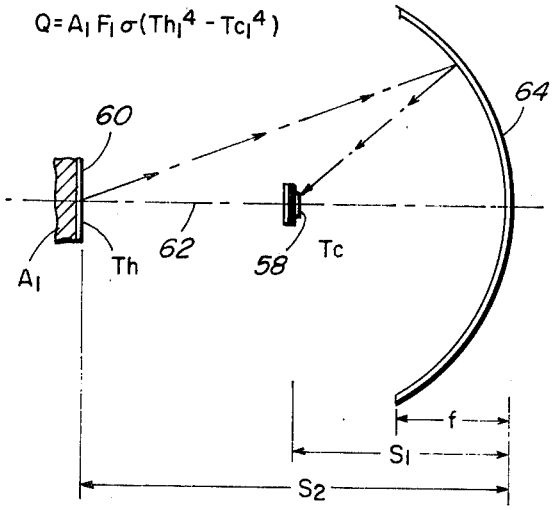
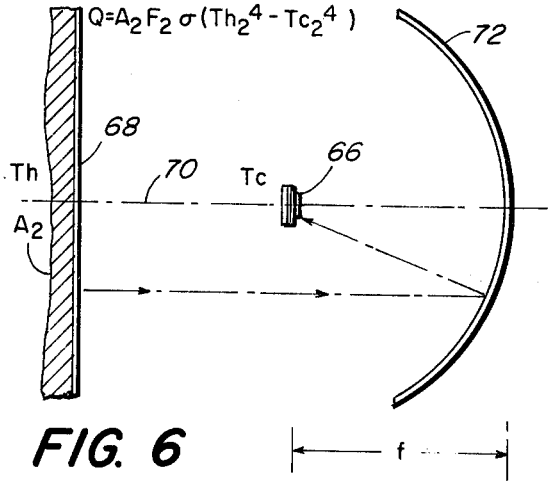
FIG. 6

INFRARED COOLER FOR RESTRICTED REGIONS

RELATED APPLICATIONS

The present application is a continuation-in-part of application Ser. No. 445,052, filed Feb. 25, 1974, is U.S. Pat. No. 3,994,277 which in turn is a continuation-in-part of application Ser. No. 422,426, filed Dec. 6, 1973 now abandoned.

BACKGROUND

1. Field of the Invention

The present invention relates to cooling devices and processes and, more particularly, to the cooling of restricted regions.

2. The Prior Art

Most conventional cooling techniques involve the indiscriminate cooling of relatively large environments even through local cooling of relatively small regions only may be desired. Heat transfer as is well known, involves the phenomena of conduction, convection and radiation. All of these phenomena operate in conventional cooling systems although conventional design often is based primarily on conduction and convection considerations.

SUMMARY OF THE INVENTION

The present invention is based on the discovery that intensified infrared cooling of a restricted subject region can be achieved by locating the subject region in the path defined by a geometric configuration, in which a small infrared radiation sink and a large infrared radiation condenser, e.g. a converging reflector, are axially related. Preferably the radiation sink is isolated from the atmosphere by an infrared transmitting envelope which precludes precipitation of moisture and which transmits infrared radiation directed from the subject region via the the radiation condenser to the radiation sink. Preferably heat is removed from the radiation sink by a thermo-electric heat exchanger, particularly a Peltier effect heat exchanger. The radiation sink, particularly the surface area communicating with the radiation condenser, is operationally electrostatic, i.e., is not a component of a closed electrical loop. In other words, the heat sink is electromotively isolated so as to be free of power dissipation that is significant in relation to infrared radiation received from the subject. The cooling configuration of the present invention is the antithesis of irradiating configurations of the prior art in the sense that the present invention predeterminedly locates a "point" radiation sink in adjacence to the focal point of an optical condensing system whereas the prior art predeterminedly locates a "point" radiation source in adjacence to the focal point of an optical condensing system. The present invention is believed to take advantage of the scientific principle that the aperture of an optical system assumes the radiance of the object it is imaging when viewed from the image point. The present invention effectively reduces mechanical problems previously inherent in radiation cooling devices. These devices are particularly useful in the maintainance of controlled temperatures for individualized cooling or medical therapy or for scientific or industrial procedures in which convenient mechanical access is precluded, for example, with respect to subject surfaces of irregular shape or minute size.

Other objects of the present invention will in part be obvious and will in part appear hereinafter.

The present invention thus comprises the devices and processes, together with their components, steps and interrelationships, which are exemplified in the present disclosure, the scope of which will be indicated in the appended claims.

BRIEF DESCRIPTION OF THE DRAWINGS

For a fuller understanding of the nature and objects of the present invention, reference is made to the following detailed description, taken in connection with the accompanying drawings, wherein:

FIG. 1 is a perspective view of a radiation cooling device embodying the present invention;

FIG. 2 is a electrical and mechanical schematic view, partly broken away, of a sub-assembly of the device of FIG. 1;

FIG. 3 is a perspective broken away view of the sub-assembly of FIG. 1;

FIG. 4 is a schematic diagram of a component of the present invention;

FIG. 5 is a schematic diagram illustrating a first system of the present invention; and FIG. 6 is a schematic diagram illustrating a second system of the present invention.

DETAILED DESCRIPTION OF THE PREFERRED EMBODIMENT

The radiation cooler of FIGS. 1, 2 and 3 comprises a point radiation sink 20 and a converging reflector 22. Sink 20 and an object region to be cooled are disposed along the axis of reflector 22 in a geometrical relationship to be described more fully below. As shown, radiation sink 20 is carried by an elongated assemblage 24, which is adjustable along the axis of reflector 22 by screws 26, 28. Screws 26, 28 have unthreaded shank portions, which are rotatable in bearings at the extremities of assemblage 24, and threaded body portions, which are turned into threaded openings in flanges 30, 32 that extend from reflector 22 in diametrically opposite directions with respect to the reflector axis. Along screws 26, 28 are indicia graduations which indicate the distance of radiation sink 20 from reflector 22 along its axis. As shown, reflector 22 is mounted universally on a stand 34 having a stable base 36, an extensible post 38 and a pivotal fixture 40. The reciprocal adjustment of post 38 is fixed by a lockscrew 42 and the angular adjustment of pivot 40 is fixed by a lockscrew 44.

Assemblage 24 includes a series of Peltier effect thermoelectric modules 46, sandwiched between a heat conducting cold plate 48 and a heat conducting hot plate 50. As shown in FIG. 2, there are seven thermoelectric modules 46, in the present embodiment, which are distributed in a series along the length of assemblage 24 and which are connected electrically in series and energized by an adjustable power supply 52 through a suitable double lead cord. Cold plate 48 is in the form of a copper bar that is registered and in contact with the cold back faces of series of modules 46. The temperature of cold plate 48 is below the freezing point of water and is adjustable at this temperature level by varying the output of power supply 52. Hot plate 50 is in the form of a copper bar that is registered and in contact with the hot front faces of series of modules 46. Radiation sink 20 is constituted by a blackened circular region on the back face of cold plate 48 midway between the extremities of assemblage 24. In one form, radiation sink 20 is composed of a copper compound such as copper oxide or copper sulfide, which is provided by chemical reaction with the face of cold plate 48. In another form, radiation sink 20 is composed of a matte black lacquer, which is provided by painting the back face of cold plate 48. Registered with radiation sink 20 is a radiation transmitting window 53. In one form, window 53 is in contact with sink 20 and in another form window 53 is slightly spaced from sink 20. In either of these forms, there are air molecules between window 53 and sink 20, the total air volume being sufficiently small so that any water molecules in the total air volume are too few to generate a condensation layer on sink 20 even though its temperature is below the freezing point of water. Surrounding window 53 and enveloping all components of assemblage 24 excepting hot plate 50 is a moisture proof jacket 54 which is composed of an elastomer or elastomeric foam such as polyisobutylene or polyurethane. At the upper and lower edges of hot plate 50 are fins 56 for heat dissipation. The edges of jacket 54 are sealed to hot plate 50 so that all of the components of assemblage 24 are sealed hermetically within the confines of an envelope defined by hot plate 50, jacket 54 and window 53.

The theoretical basis of the present invention is not understood with certainty. However, the operation of the radiation cooler of the present invention is believed to depend upon the following theoretical considerations.

Generally heat transfer by infrared radiation occurs between a relatively hot surface and a relatively cold surface in accordance with the following formula $$Q = A\,F\,\sigma(T_n^4 - T_c^4)$$

where

Q = heat transferred per unit time (Btu/hr)

A = area of one of the surfaces ($ft^2$)

F = a dimensionless configuration factor that is a direct function of the magnitudes of the areas of both surfaces, the degree of parallelism of the surfaces, the closeness of the spacing of the surfaces, the closeness of the approximation to black body emissivity of the surfaces, and ambient conditions;

$\sigma$ = the Stefan-Boltzman constant ($0.171 \times 10^{-8}$ Btu/$ft^2$ h [deg R]$^4$)

$T_n$ = the absolute temperature of the hot surface (degrees R)

$T_c$ = the absolute temperature of the cold surface (degrees R)

(R stands for Rankin = degrees F + 460)

The foregoing indicates that cooling by infrared radiation is a direct function of surface area. Difficulties are encountered in attempting to utilize a large open cooling surface for radiation transfer when its temperature is below freezing because of mechanical problems, particularly difficulties associated with frost prevention. In accordance with the present invention, a geometrically small radiation sink, in which frost and other mechanical problems can be easily controlled, is converted effectively into a geometrically large radiation sink by disposing it on the axis of an infrared optical condenser of relatively large diameter.

The configuration of the reflector, in various modifications is spherical, parabolic, elliptical or aspheric. In FIG. 5, for example, a radiation sink 58 and a subject region 60 of restricted area $A_1$, to be cooled, are positioned at conjugate points along the axis 62 of reflector 64. The configuration factor $F_1$, is such that a significant proportion of divergent radiation from subject region 60 is converged by reflector 64 toward radiation sink 58. In FIG. 6, for example, the radiation sink 66 and a subject region 68 of extended area $A_2$, to be cooled, are positioned respectively at the focal point and at infinity along the axis 70 of reflector 72. The configuration factor $F_2$ is such that a significant proportion of parallel radiation from subject region 68 is converged by reflector 72 toward radiation sink 66.

From an optical standpoint, optimum positioning of the subject to be cooled may be determined approximately by calculating conjugate distances and magnifications of the radiation sink and the subject surface in terms of what may be thought of as negative infrared or cooling rays emitted from the radiation sink. More specifically, in FIG. 5, in the case where mirror 64 is spherical, the positions of sink 58 and subject 60 are related by the formulae:

$$\frac{1}{s_1} + \frac{1}{S_2} = \frac{1}{f} \text{ and } \frac{A_1}{A_2} = m$$

where:

F = focal distance of mirror 64

$s_1$ = distance of sink 58 from mirror 64

$s_2$ = distance of subject 60 from mirror 64

$A_1$ = area of sink 58

$A_2$ = area of subject 60 and m = magnification of the system

In FIG. 6, in the case where mirror 72 is elliptical, sink 66 is positioned at the first focal point and subject 68 is positioned at the second focal point of the mirror. In FIG. 6, in the case where mirror 72 is parabolic, sink 66 is positioned at the focal point of mirror 72. In accordance with the present invention, it is preferred that, in terms of cross-sectional area in planes that are normal to the optical axis, the area of the infrared radiation condenser is at least 10 times the area of the radiation sink and that most of the exposed surface of the radiation sink, say at least 80%, communicates optically with the infrared radiation condenser. In practice, the ratio of focal length to diameter of the infrared radiation condenser, i.e. the F/number, should not exceed 2.0.

In one modification of the illustrated radiation cooler, the converging reflector is a Fresnel reflector. This Fresnel reflector, which is disposed in generally a flat plane, is characterized by concentric conoidal facets that correspond to any of the spherical, parabolic, elliptical or aspheric configurations of the reflector of FIG. 1. Preferably, window 53 is composed of an infrared transmitting material such as fused quartz, saphire, magnesium flouride, magnesium oxide, calcium flouride, arsenic trisulfide, zinc sulfide, silicon, zinc selenide, germanium, sodium fluoride, cadmium telluride or thallium bromide-iodide. As shown in FIGS. 5 and 6, it is essential that subject surface 60 or 68 be the only energy source communicating with radiation sink 58 or radiation sink 66. In other words, the uninterrupted thermally conductive path established by the radiation sink and cold plate 48 is electromotively isolated, i.e., it avoids electromotive forces that would tend to generate heat by electrical flow in a circuit.

Preferably thermoelectric heat exchange modules 46 incorporate arrays of small thermoelectric elements of the Peltier type, as shown in FIG. 4, in which a load 74 to be cooled and a heat sink 76 are separated by a pair of N and P semiconductors 78, 80. One end of each semiconductor 78, 80 is bonded to a common electrical conductor 82. The opposite extremities of semiconductors 78, 80 are bonded to isolated electrical conductors 82, 84. Electrical conductor 82 is attached to load 74 by a thermally conducting, electrically insulating spacer 86. Likewise, electrical conductors 82, 84 are attached to heat sink 76 by a thermally conducting, electrically insulating spacer 90. When direct current is transmitted via leads 91, 92 through electrical conductor 82, N semiconductor 78, electrical conductor 82, P semiconductor 80 and electrical conductor 84, cooling of load 74 occurs. In accordance with the present invention, modules 46 provide a heat exchanger that is matched with the thermal path extending from the radiation sink to establish a heat flow of at least 10 Btu/hr(ft$^2$) (F°) and, preferably, at least 50 Btu/hr(ft$^2$) (F°) when associated with an infrared radiation condenser of one square foot area for medical applications.

In operation, the device of FIGS. 1, 2 and 3, ordinarily is positioned with respect to a subject surface to be cooled in such a way that its radiation sink is no farther away from the subject surface than a distance equal to twice the diameter of the reflector and such that the optical path from the infrared radiation emitting subject surface via the infrared radiation condenser to the infrared radiation absorbing radiation sink is uninterrupted and unobscured so that heat flow from a subject surface to the heat sink and through the heat conduit is continuous. In other words, the device is positioned quite closely to the subject surface in order to achieve the desired heat flow. In accordance with the present invention, the infrared radiation of primary interest is in the range of from 0.8 to 50 microns, particularly in the range of from 4 to 40 microns, i.e., the range associated with the temperature of the human body. Preferably, envelope 52 is composed of a material that is substantially transparent in a substantial portion of the range of from 4 to 40 microns.

Since certain changes may be made in the present disclosure without departing from the present invention, it is intended that all matter contained in the foregoing description or shown in the accompanying drawings be interpreted in an illustrative and not in a limiting sense.

What is claimed is:

1. A radiation cooler for a subject at approximately the temperature of the human body, said radiation cooler comprising base means, thermal means, and adjusting means for locating and orienting said thermal means at selected locations and orientations with respect to said base means, said thermal means including infrared radiation condensing means of extended geometrical dimension for optical communication with said subject, substantially black body radiation sink means of restricted geometrical dimension in optical communication with said infrared radiation condensing means, window means for isolating said radiation sink means from the atmosphere, said window means having at least an infrared radiation transmitting portion, heat exchanger means for withdrawing heat from said radiation sink means, and power supply means for energizing said heat exchanger means, said heat exchanger means comprising thermoelectric means, said radiation sink means being located between said thermoelectric means and said radiation condensing means.

2. The radiation cooler of claim 1 wherein said radiation condensing means is a reflector.

3. The radiation cooler of claim 1 wherein said power supply means includes electrical transformer means.

4. The radiation cooler of claim 1 wherein said infrared radiation transmitting portion transmits infrared radiation substantially in said range of 4 to 40 microns.

5. The radiation cooler of claim 1 wherein said infrared radiation transmitting portion is composed essentially of sodium fluoride.

6. The radiation cooler of claim 1 wherein said infrared radiation transmitting portion is composed essentially of cadmium telluride.

7. The radiation cooler of claim 1 wherein said infrared radiation transmitting portion is composed essentially of thallium bromide-iodide.

8. A radiation cooler comprising base means, thermal means, and adjusting means for locating and orienting said thermal means with respect to said base means, said thermal means including substantially black body infrared radiation sink means of restricted geometrical dimension and infrared radiation condensing means defining an optical axis and a pair of optical surfaces that are conjugately related, said radiation sink means being disposed along said axis and being located substantially at one of said pair of optical surfaces, and heat exchanger means for removing heat from said radiation sink means.

9. The radiation cooler of claim 8 wherein said radiation sink means comprises a black body surface and an infrared radiation transmitting window enclosing said black body surface.

10. The radiation cooler of claim 8 wherein said heat exchanger means is in contact with said radiation sink means.

11. The radiation cooler of claim 8 wherein said reflector is spherical.

12. The radiation cooler of claim 8 wherein one of said conjugate surfaces is at infinity.

13. The radiation cooler of claim 8 wherein said reflector is elliptical.

14. The radiation cooler of claim 8 wherein said reflector is aspheric.

15. The radiation device of claim 8 wherein said thermoelectric means is contained within a hermatic chamber.

16. A radiation cooler comprising base means, thermal means, and adjusting means for locating and orienting said thermal means with respect to said base means, said thermal means including substantially black body infrared radiation absorption means of restricted geometrical dimension and infrared radiation condensing means of extended geometrical dimension, said infrared radiation absorption means being disposed along an axis, said infrared radiation absorption means having an electromotively isolated infrared radiation receiving face in optical communication with said infrared radiation condensing means, heat exchanger means for removing heat from said infrared radiation absorption means, and infrared radiation transmitting window means isolating said infrared radiation receiving face mechanically from its environment, said heat exchanger means including a plurality of serially electrically connected thermoelectric modules, a relatively cold thermal conductor and a relatively hot thermal conductor, said thermoelectric modules being sandwiched between said relatively cold thermal conductor and said relatively hot thermal conductor.

17. The radiation cooler of claim 16 wherein said radiation absorption means is on said relatively cold thermal conductor.

18. The radiation cooling device of claim 16 wherein said infrared radiation condenser means is a spherical reflector and said infrared radiation absorption means is located at one of a pair of conjugate points of said spherical reflector.

19. The radiation cooling device of claim 16 wherein said infrared radiation condenser means is a parabolic reflector and said infrared radiation absorption means is located at the focal point of said reflector.

20. The radiation cooling device of claim 16 wherein said infrared radiation condenser means is an elliptical reflector and said infrared radiation absorption means is located at one of the foci of said reflector.

21. The radiation cooler of claim 16 wherein said reflector is aspheric.

22. The radiation cooler of claim 16 wherein said heat exchanger means is a Peltier effect thermoelectric means.

23. The radiation cooler of claim 16 wherein said infrared radiation condenser means is a Fresnel reflector.

24. The radiation cooler of claim 16 wherein said infrared radiation condenser means is an infrared transmitting window.

25. The radiation cooling device of claim 16 wherein said window transmits primarily in the range of from 4 to 40 microns.

26. Apparatus for cooling a subject heat load that emits infrared radiation, said apparatus comprising geometrically extended means for focusing a proportion of said infrared radiation in a geometrically restricted region, geometrically restricted means in said restricted region presenting an electrostatic, substantially black body face for receiving said proportion of said infrared radiation, window means for transmitting said infrared radiation and for hermetically enclosing said electrostatic face, mounting means for predeterminedly locating said geometrically restricted means and said geometrically extended means with respect to each other, thermoelectric heat exchanger means in said mounting means having relatively cold thermal means and relatively hot thermal means, said electrostatic face being on said cold thermal means, heat dissipation means on said mounting means extending in thermal communication with said hot thermal means, base means, and pivot means adjustably connecting said mounting means to said base means.

27. A radiation cooler for a subject at approximately the temperature of the human body, said radiation cooler comprising infrared radiation condensing means of extended geometrical dimension for optical communication with said subject, substantially black body radiation sink means of restricted geometrical dimension in optical communication with said infrared radiation condensing means, window means for isolating said radiation sink means from the atmosphere, said window means having at least an infrared radiation transmitting portion, heat exchanger means for withdrawing heat from said radiation sink means, power supply means for energizing said heat exchanger means, and adjusting means for controlling the distance between said radiation sink means and said condensing means.

28. A radiation cooler for a subject at approximately the temperature of the human body, said radiation cooler comprising infrared radiation condensing means of extended geometrical dimension for optical communication with said subject, substantially black body radiation sink means of restricted geometrical dimension in optical communication with said infrared radiation condensing means, window means for isolating said radiation sink means from the atmosphere, said window means having at least an infrared radiation transmitting portion, heat exchanger means for withdrawing heat from said radiation sink means, power supply means for energizing said heat exchanger means, and adjusting means for controlling the temperature of said radiation sink means.

29. A radiation cooler for a subject at approximately the temperature of the human body, said radiation cooler comprising infrared radiation condensing means of extended geometrical dimension for optical communication with said subject, substantially black body radiation sink means of restricted geometrical dimension in optical communication with said infrared radiation condensing means, window means for isolating said radiation sink means from the atmosphere, said radiation sink means and said window means having a space therebetween, said window means having at least an infrared radiation transmitting portion, heat exchanger means for withdrawing heat from said radiation sink means, power supply means for energizing said heat exchanger means, the space between said radiation sink means and said window means containing air.

30. A radiation cooler for a subject at approximately the temperature of the human body, said radiation cooler comprising infrared radiation condensing means of extended geometrical dimension for optical communication with said subject, substantially black body radiation sink means of restricted geometrical dimension in optical communication with said infrared radiation condensing means, window means for isolating said radiation sink means from the atmosphere, said window means having at least an infrared radiation transmitting portion, heat exchanger means for withdrawing heat from said radiation sink means, and power supply means for energizing said heat exchanger means, the temperature of said radiation sink means being below the freezing point of water.

31. A radiation cooler comprising substantially black body infrared radiation sink means of restricted geometrical dimension and infrared radiation condensing means defining an optical axis and a pair of optical surfaces that are conjugately related, said radiation sink means being disposed along said axis and being located substantially at one of said pair of optical surfaces, infrared radiation transmitting window means communicating with said radiation sink means, and heat exchanger means for removing heat from said radiation sink means.

32. A radiation cooler comprising substantially black body infrared radiation sink means of restricted geometrical dimension and infrared radiation condensing means defining an optical axis and a pair of optical surfaces that are conjugately related, said radiation sink means being disposed along said axis and being located substantially at one of said pair of optical surfaces, infrared radiation transmitting window means communicating with said radiation sink means, sealing means for isolating the region between said radiation sink means and said radiation transmitting window means from the atmosphere, and heat exchanger means for removing heat from said radiation sink means.

33. A radiation cooler comprising a substantially black body, infrared radiation absorption element of restricted geometrical dimension and infrared radiation condensing reflector of extended geometrical dimension, said infrared radiation absorption element being disposed along the axis of said infrared radiation condensing reflector, a thermoelectric heat exchanger for removing heat from said infrared radiation absorption element, and an infrared radiation transmitting window isolating said infrared radiation absorption element mechanically from its environment, said heat exchanger including a plurality of serially electrically connected thermoelectric modules, a relatively cold thermal conductor and a relatively hot thermal conductor, said thermoelectric modules being sandwiched between said relatively cold thermal conductor and said relatively hot thermal conductor, said infrared radiation absorption element being in contact with said relatively cold thermal conductor.

* * * * *